US008188805B2

(12) United States Patent
Nomura et al.

(10) Patent No.: US 8,188,805 B2
(45) Date of Patent: May 29, 2012

(54) TRIPLATE LINE-TO-WAVEGUIDE TRANSDUCER HAVING SPACER DIMENSIONS WHICH ARE LARGER THAN WAVEGUIDE DIMENSIONS

(75) Inventors: Taketo Nomura, Chikusei (JP); Masahiko Oota, Oyama (JP); Hisayoshi Mizugaki, Chikusei (JP); Yuichi Shimayama, Yuki (JP); Takashi Saitou, Chikusei (JP); Masaya Kirihara, Chikusei (JP); Keisuke Iijima, Chikusei (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 201 days.

(21) Appl. No.: 12/532,551

(22) PCT Filed: Feb. 26, 2008

(86) PCT No.: PCT/JP2008/053300

§ 371 (c)(1),
(2), (4) Date: Sep. 22, 2009

(87) PCT Pub. No.: WO2008/114580

PCT Pub. Date: Sep. 25, 2008

(65) Prior Publication Data

US 2010/0085133 A1 Apr. 8, 2010

(30) Foreign Application Priority Data

Mar. 22, 2007 (JP) ..... P2007-074529
May 24, 2007 (JP) ..... P2007-138194

(51) Int. Cl.
*H01P 5/107* (2006.01)

(52) U.S. Cl. ..... 333/26

(58) Field of Classification Search ..... 333/26
See application file for complete search history.

(56) References Cited

U.S. PATENT DOCUMENTS

| | | | | |
|---|---|---|---|---|
| 2,877,429 | A * | 3/1959 | Sommers et al. | 333/24 R |
| 4,562,416 | A * | 12/1985 | Sedivec | 333/26 |
| 6,545,572 | B1 | 4/2003 | Oath et al. | |
| 2007/0229380 | A1 | 10/2007 | Dota et al. | |

FOREIGN PATENT DOCUMENTS

| | | | |
|---|---|---|---|
| EP | 1 592 081 | A1 | 11/2005 |
| EP | 1 860 731 | A1 | 11/2007 |
| JP | H6-70305 | | 9/1994 |
| JP | 2004-215050 | | 7/2004 |
| WO | WO 2006/098054 | A1 | 9/2006 |

OTHER PUBLICATIONS

The English Translation of International Preliminary Report on Patentability dated Oct. 1, 2009. EP Search Report of Appln. No. 08711984 dated May 19, 2010 in English.

* cited by examiner

*Primary Examiner* — Benny Lee
(74) *Attorney, Agent, or Firm* — Antonelli, Terry, Stout & Kraus, LLP.

(57) ABSTRACT

A ground conductor (1) has a through hole provided through an area thereof for connection with a waveguide (6), with dimensions substantially equal to cavity dimensions of the waveguide (6), and a metallic spacer (7*a*) is provided as a holding element for a film substrate (4), with an even thickness to a dielectric substrate (2*a*), the metallic spacer (7*a*) having dimensions E1 and E2 of cavity walls thereof changed in accordance with a desirable frequency, and cooperating with another metallic spacer (7*b*) having substantially equal dimensions to the metallic spacer (7*a*), to sandwich the film substrate (4) in between, and in addition, an upper ground conductor (5) is arranged on the other metallic spacer (7*b*), and a quadrate resonant patch pattern (8) is formed at an end of the strip line conductor (3) formed to the film subs ate (4), on an area corresponding to a transducer end of the waveguide (6), while a combination of the quadrate resonant patch pattern (8) and the waveguide (6) is arranged such that the quadrate resonant patch pattern (8) has a center position thereof coincident with a center position of the cavity dimensions of the waveguide (6).

5 Claims, 3 Drawing Sheets

(a)

(b)

TRIPLATE LINE-TO-WAVEGUIDE TRANSDUCER HAVING SPACER DIMENSIONS WHICH ARE LARGER THAN WAVEGUIDE DIMENSIONS

TECHNICAL FIELD

The present invention relates to a triplate line-to-waveguide transducer with a structure for millimeter wavelengths.

BACKGROUND ART

Recent planer antennas for microwaves or millimeter wavelengths have an electric feed-through system configured as a triplate transmission line to provide a highly efficient characteristic, as a prevailing trend. Planer antennas of such a triplate line feed-through system are adapted to synthesize power fed from antenna elements through the triplate transmission line, and in most cases they have, at an interconnect between a final end that outputs synthesized power and an RF signal processing circuit, a triplate line-to-waveguide transducer implementing easy assembly and high connection integrity.

FIGS. 1(*a*) and 1(*b*) illustrate, as a part of the background, a configuration of such a triplate line-to-waveguide transducer (refer e.g. to Japanese Utility Model Registration Application Laid-Open Publication No. 06-070305 and Japanese Patent Application Laid-Open Publication No. 2004-215050). In the conventional configuration, in order for the conversion for waveguide system to be facilitated with a small loss, there was a triplate transmission line made up by: a film substrate 4 {FIG. 1(*b*)} formed with a strip line conductor 3, and laminated over a surface of a ground conductor 1 {FIG. 1(*b*)}, with a dielectric substrate 2*a* {FIG. 1(*b*)} in between; and an upper ground conductor 5 laminated over a surface of the film substrate, with another dielectric substrate 2*b* {FIG. 1(*b*)} in between.

Moreover, for connection of such the circuit system to an input portion of a waveguide 6 {FIG. 1(*b*)}, the ground conductor 1 includes a through hole with dimensions substantially equal to cavity dimensions of the waveguide 6. Further, the film substrate 4 was held by a metallic spacer 7*a* {FIG. 1(*b*)} with an even thickness to the dielectric substrate 2*a*, and another metallic spacer 7*b* {FIG. 1(*b*)} with substantially equal dimensions to that metallic spacer 7*a*, with the film substrate in between, and this metallic spacer 7*b* had an upper ground conductor 5 arranged thereon. The strip line conductor 3 formed on the film substrate 4 had a square resonant patch pattern 8 {FIG. 1(*a*)} formed on an area corresponding to a transducer end of the waveguide 6. The square resonant patch pattern 8 had a center position thereof coincident with a center position of cavity dimensions of the waveguide 6. The triplate line-to-waveguide transducer was thus made up.

As illustrated in FIG. 1(*a*), the square resonant patch pattern 8 had a dimension L1 in a direction in which the line was connected, and a dimension L2 in a direction perpendicular to the direction of line connection, as a prescribed dimension, permitting implementation of the triplate line-to-waveguide transducer with a low-loss characteristic over a wide bandwidth within a desirable range of frequencies.

In the conventional configuration of triplate line-to-waveguide transducer illustrated in FIG. 1, the square resonant patch pattern 8 had dimensions thereof restricted by cavity wall dimensions of the metallic spacers 7*a* and 7*b*, with a resultant restriction to the lower limit of resonance frequency, as an issue.

SUMMARY OF THE INVENTION

It is an object of the present invention to provide a triplate line-to-waveguide transducer allowing for fabrication and high connection integrity, at a low cost, with a minimized lower limit of resonance frequency relative to the conventional configuration, without detriment to the low-loss characteristic over a wide bandwidth in the past.

According to an aspect of the present invention, a triplate line-to-waveguide transducer includes a transducer portion configured with and between a waveguide and a triplate transmission line comprised of a film substrate formed with a strip line conductor and laminated over a surface of a ground conductor, with a dielectric substrate in between, and an upper ground conductor laminated over a surface of the film substrate, with another dielectric substrate in between, and the triplate line-to-waveguide transducer comprises a through hole provided through an area on the ground conductor for connection with the waveguide, with dimensions substantially equal to cavity dimensions of the waveguide, a metallic spacer provided as a holding element for the film substrate, with an even thickness to the dielectric substrate, and cooperating with another metallic spacer having substantially equal dimensions to the metallic spacer, to sandwich the film substrate in between, the upper ground conductor being arranged on the other metallic spacer, a quadrate resonant patch pattern formed at an end of the strip line conductor formed to the film substrate, on an area corresponding to a transducer end of the waveguide, and a combination of the quadrate resonant patch pattern and the waveguide arranged for the quadrate resonant patch pattern to have a center position thereof coincident with a center position of the cavity dimensions of the waveguide.

According to another aspect of the present invention, in the triplate line-to-waveguide transducer, the quadrate resonant patch pattern has a dimension thereof in a direction of line connection set up as a free space wavelength $\lambda_0$ of desirable frequency times approximately 0.32, and a dimension thereof in a direction perpendicular to the direction of line connection set up as the free space wavelength $\lambda_0$ of desirable frequency times approximately 0.38.

According to another aspect of the present invention, in the triplate line-to-waveguide transducer, those dimensions of cavity walls of the metallic spacers are set up as a free space wavelength $\lambda_0$ of desirable frequency times approximately 0.59.

According to the present invention, a triplate line-to-waveguide transducer is made up by component members such as a ground conductor, an upper ground conductor, and metallic spacers that can be fabricated at a low cost by a punching, such as of a metallic plate with a desirable thickness, allowing for facile fabrication and high connection integrity, at a low cost, with a minimized lower limit of resonance frequency relative to a conventional configuration, without detriment to a low-loss characteristic over a wide bandwidth in the past.

BEST MODE FOR CARRYING OUT THE INVENTION

There will be described into details an embodiment of triplate line-to-waveguide transducer according to the present invention, with reference to the drawings.

Figure 1:
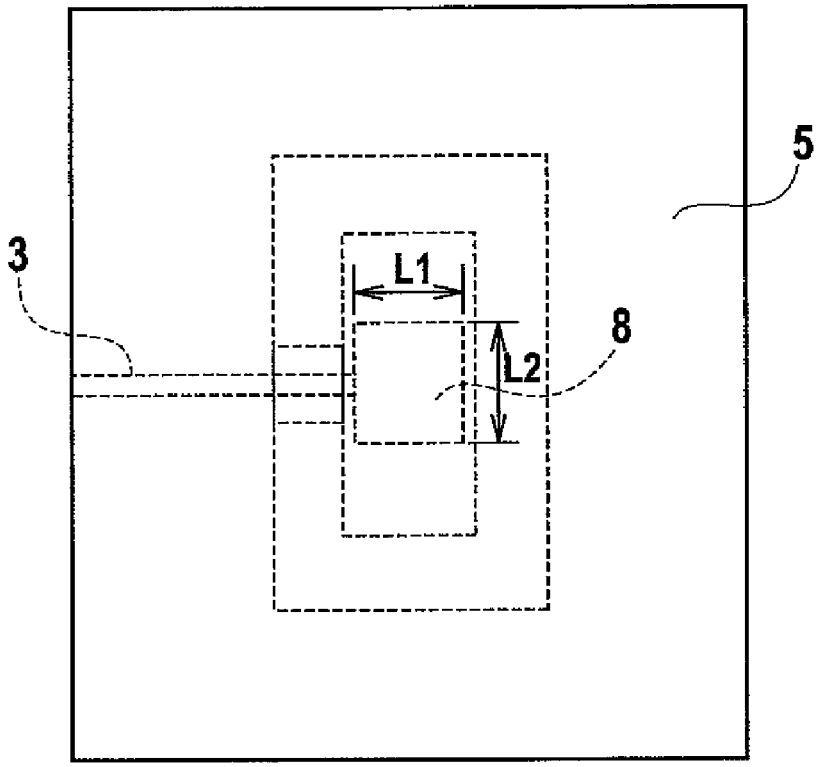
FIG. 1 PRIOR ART
FIG. 1(*a*) is a plan view of a conventional example, and FIG. 1(*b*) is a sectional view thereof.
Figure 1:
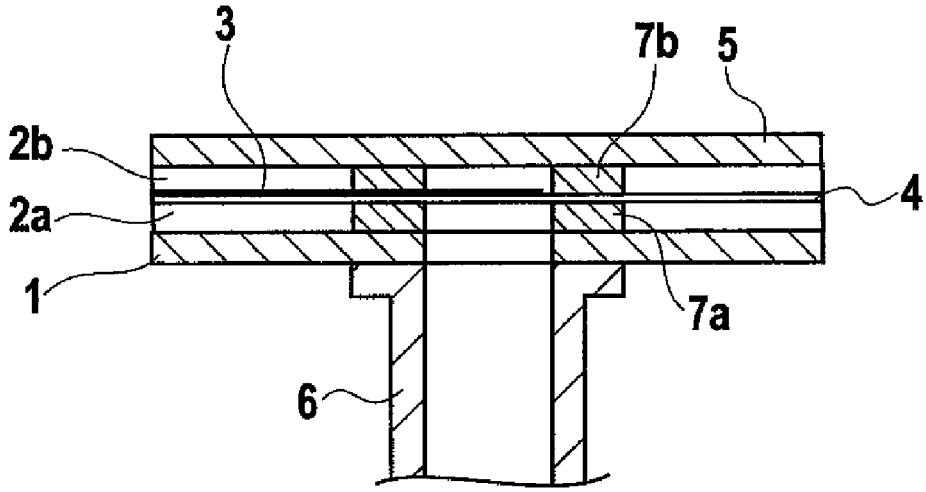
FIG. 1 PRIOR ART
Figure 2:
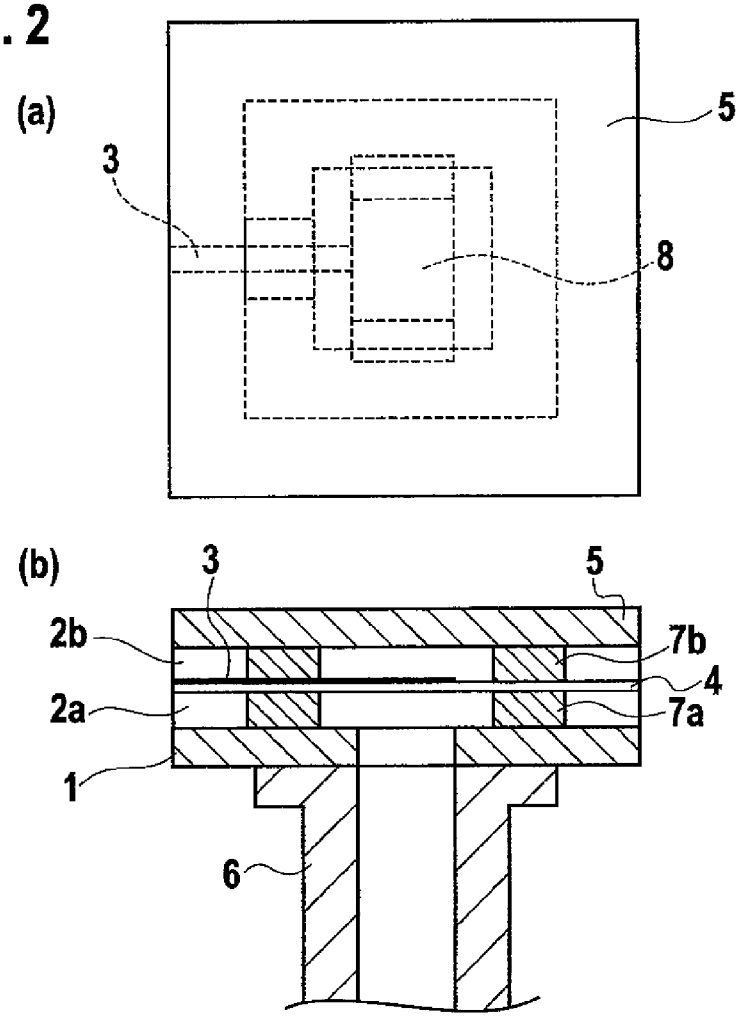
FIG. 2(*a*) is a plan view of an embodiment of the present invention, and FIG. 2(*b*) is a sectional view thereof.

According to an aspect of the present invention, as illustrated in FIG. 2, a triplate line-to-waveguide transducer includes a transducer portion configured with and between a waveguide 6 and a triplate transmission line comprised of a film substrate 4 formed with a strip line conductor 3 and laminated over a surface of a ground conductor 1, with a dielectric substrate 2*a* in between, and an upper ground conductor 5 laminated over a surface of the film substrate, with another dielectric substrate 2*b* in between, and the triplate line-to-waveguide transducer comprises a through hole provided through an area on the ground conductor 1 for connection with the waveguide, with dimensions substantially equal to cavity dimensions of the waveguide 6, a metallic spacer 7*a* provided as a holding element for the film substrate 4, with an even thickness to the dielectric substrate 2*a*, and cooperating with another metallic spacer 7*b* having substantially equal dimensions to the metallic spacer 7*a*, to sandwich the film substrate (4) in between, the upper ground conductor 5 being arranged on the other metallic spacer 7*b*, a quadrate resonant patch pattern 8 formed at an end of the strip line conductor 3 formed to the film substrate 4, on an area corresponding to a transducer end of the waveguide 6, and a combination of the quadrate resonant patch pattern (8) and the waveguide (6) arranged for the quadrate resonant patch pattern 8 to have a center position thereof coincident with a center position of the cavity dimensions of the waveguide 6.

According to another aspect of the present invention, as illustrated in FIGS. 2(*a*) and 2(*b*), in the triplate line-to-waveguide transducer, the quadrate resonant patch pattern 8 has a dimension L1 thereof in a direction of line connection set up as a free space wavelength $\lambda_0$ of desirable frequency times approximately 0.32, and a dimension L2 thereof in a direction perpendicular to the direction of line connection set up as the free space wavelength $\lambda_0$ of desirable frequency times approximately 0.38.

Figure 3:
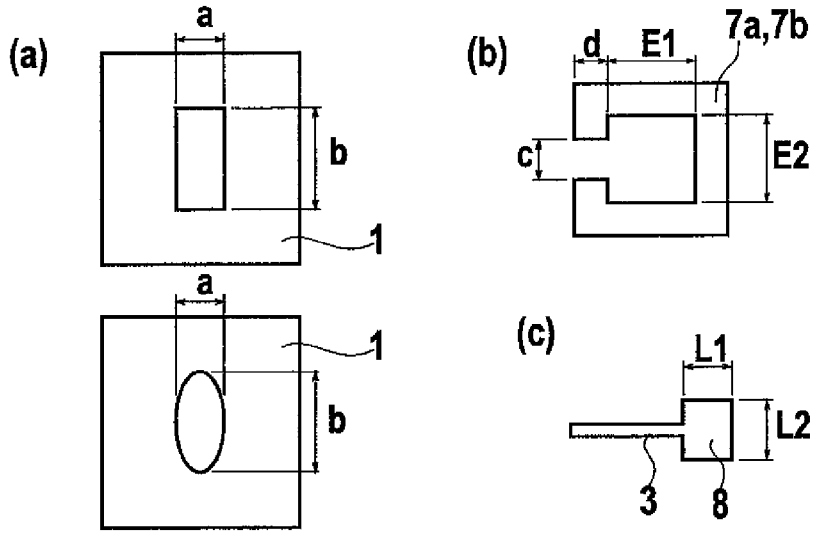
FIGS. 3(*a*) to (*c*) are plan views of parts according to embodiment examples of the present invention.

According to another aspect of the present invention, as illustrated in FIGS. 2(*a*) and 2(*b*), in the triplate line-to-waveguide transducer, those dimensions E1 and E2 of cavity walls of the metallic spacers 7*a* and 7*b* illustrated in FIG. 3 (*b*) are set up as a free space wavelength $\lambda_0$ of desirable frequency times approximately 0.59.

According to the present invention, a triplate line-to-waveguide transducer is made up by component members such as a ground conductor 1, an upper ground conductor 5, and metallic spacers 7*a* and 7*b* that can be fabricated at a low cost by a punching, such as of a metallic plate with a desirable thickness, allowing for facile fabrication and high connection integrity, at a low cost, with a minimized lower limit of resonance frequency relative to a conventional configuration, without detriment to a low-loss characteristic over a wide bandwidth in the past.

FIGS. 2(*a*) and 2(*b*) illustrate the triplate line-to-waveguide transducer, which includes a triplate transmission line that is made up, in order for the conversion for waveguide system to be facilitated with a small loss, by: a film substrate 4 {FIG. 2(*b*)} formed with a strip line conductor 3, and laminated over a surface of a ground conductor 1 {FIG. 2(*b*)}, with a dielectric substrate 2*a* {FIG. 2(*b*)} in between; and an upper ground conductor 5 laminated over a surface of the film substrate, with another dielectric substrate 2*b* {FIG. 2(*b*)} in between.

Moreover, for connection of the circuit system to an input portion of a waveguide 6 {FIG. 2(*b*)}, the ground conductor 1 has a through hole provided with dimensions substantially equal to cavity dimensions of the waveguide 6, i.e., a×b (refer to FIG. 3(*a*)). The through hole may well be an elliptic shape of dimensions a×b as shown in FIG. 3(*a*). Further, the film substrate 4 is held by provision of a combination of a metallic spacer 7*a* {FIG. 2(*b*)} with an even thickness to the dielectric substrate 2*a*, and another metallic spacer 7*b* {FIG. 2(*b*)} with substantially equal dimensions to that metallic spacer 7*a*, with the film substrate in between. This metallic spacer 7*b* has an upper ground conductor 5 arranged thereon. The strip line conductor 3 formed on the film substrate 4 has a quadrate resonant patch pattern 8 {FIG. 2(*a*)} formed on an area corresponding to a transducer end of the waveguide 6. The quadrate resonant patch pattern 8 has a center position thereof coincident with a center position of the cavity dimensions of waveguide 6.

FIG. 3(*b*) illustrates metallic spacers 7*a* and 7*b* as parts of the triplate line-to-waveguide transducer shown in FIG. 2 in accordance with the present invention. Such parts may well be fabricated by punching a metal plate of a desirable thickness.

Figure 4:
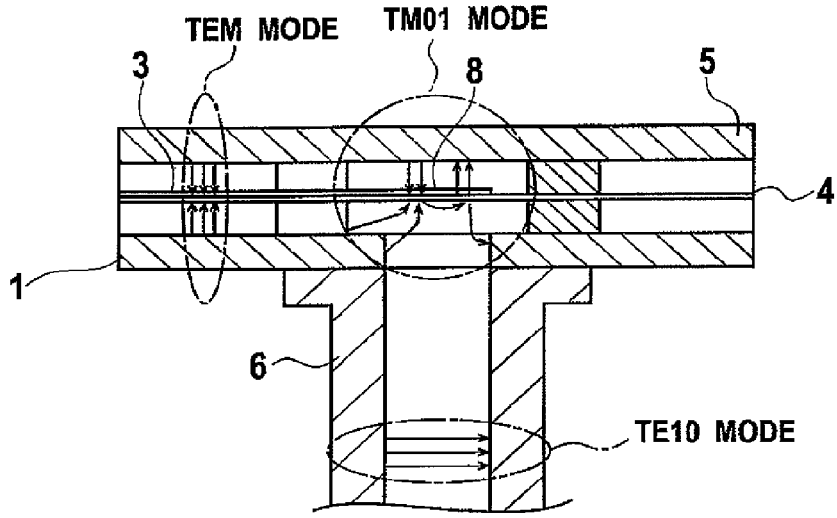
FIG. 4 is a sectional view describing conversion of excitation modes according to the present invention.

In this invention, as illustrated in FIG. 4, for instance, the quadrate resonant patch pattern 8 is formed on a surface area of the film substrate 4, and cooperates with the upper ground conductor 5 to have an excitation mode TM01 excited in between. In this connection, the triplate transmission line is configured with the strip line conductor 3 formed on a surface region of the film substrate 4 between ground conductors 1 and 5, and has an excitation mode TEM, which is transduced to the mode TM01 between the quadrate resonant patch pattern 8 and the ground conductor 5, and further transduced to an excitation mode TE10 in the waveguide 6 of a quadrate form.

The component parts are to be assembled with an established coincidence among a center position of the quadrate resonant patch pattern 8, a center position of cavity dimensions of the waveguide 6, a center position of the through hole of ground conductor 1, and center positions of cavity walls of dimensions E1 by E2 (in FIG. 3(*b*)) of the metallic spacers 7*a* and 7*b*. The component parts may well be assembled by use of guide pins or the like for the positioning to be accurate, and fastened for fixation such as by screws.

In this invention, preferably, the quadrate, resonant patch pattern 8 should have (as illustrated in FIG. 3(*c*)) a dimension L1 thereof in a direction of line connection to stripline conductor 3 set up as a free space wavelength $\lambda_0$ of desirable frequency times approximately 0.32, and a dimension L2 thereof in a direction perpendicular to the direction of line connection set up as the free space wavelength $\lambda_0$ of desirable frequency times approximately 0.38.

The dimension L1, set as the free space wavelength $\lambda_0$ of desirable frequency times approximately 0.32, comes near the cavity dimension 'a' of the waveguide times approximately 0.98, enabling a smooth conversion of different modes of electric and magnetic waves. Preferable in that respect is the free space wavelength $\lambda_0$ times a factor within a range of 0.30 to 0.34. The dimension L2, set as the free space wavelength $\lambda_0$ of desirable frequency times approximately 0.38, renders an extended bandwidth available as a bandwidth that allows for a secured return loss. Preferable in this respect is the free space wavelength $\lambda_0$ times a factor within a range of 0.32 to 0.4.

In this invention, preferably, the metallic spacers 7*a* and 7*b* should have dimensions E1 and E2 of cavity walls thereof in FIG. 3(*b*) set up as the free space wavelength $\lambda_0$ of desirable frequency times approximately 0.59. The dimensions E1 and E2, set as the free space wavelength $\lambda_0$ of desirable frequency times approximately 0.59, ease up the restriction to dimensions of the quadrate resonant patch pattern 8, allowing for a minimized lower limit of resonant frequency. Preferable in this respect is the free space wavelength $\lambda_0$ times a factor within a range of 0.56 to 0.62.

The film substrate 4 employs a film as a substrate. For example, the substrate may be a flexible substrate with a metal foil such as a copper foil glued thereon. Unnecessary copper foil (metal foil) segments may be removed by etching to form a set of radiation elements with strip conductor lines for their connection. The film substrate may be configured as a copper-glued planer lamination that has a copper foil glued on a thin resin plate in the form of a resin-impregnated glass cloth. The film may be a film of polyethylene, polypropylene, polytetrafluoroethylene, fluorinated ethylene propylene copolymer, ethylene tetrafluoroethylene copolymer, polyamide, polyimide, polyamide-imide, polyarylate, thermoplastic polyimide, polyetherimide, polyether ether ketone, polyethylene terephthalate, polybutylene terephthalate, polystyrene, polysulfone, polyphenylene ether, polyphenylene sulfide, polymethylpentene, or the like. There may be an adhesive agent used for adhesion between film and metal foil. For heat-resistance, dielectric property, and general versatility, preferable is a flexible substrate in the form of a polyimide film with a laminated copper foil. Fluorinated films are preferable for use in view of dielectric characteristics.

For the ground conductor 1 as well as the upper ground conductor 5, there may be use of any metallic plate or metal plated plastic plate as available, while aluminum plates are preferable from viewpoints of light weight and possible low-cost fabrication. They may be configured as a flexible substrate that has a copper foil glued on a film as a substrate, or as a copper-glued planer lamination that has a copper foil glued on a thin resin plate in the form of a resin-impregnated glass cloth.

The waveguide 6, as well as the through hole provided through the ground conductor 1 with dimensions substantially equal to the cavity dimensions, may preferably have a quadrate shape. This may well be an elliptic shape capable of an equivalent transmission of frequencies with respect to the quadrate shape. For the dielectric substrates 2*a* and 2*b*, there may well be use of foam or the like that has a small relative permittivity to the air. The foam may be polyolefin foam such as polyethylene or polypropylene, polystyrene foam, polyurethane foam, polysilicon foam, or rubber foam, while polyolefin foam is preferable as having a smaller relative permittivity to the air.

Description is now made of a specific example of embodiment of the present invention.

FIG. 2 is an illustration of the specific example. In the configuration, employed as the ground conductor 1 was an aluminum plate 3 mm thick; as the dielectric substrates 2*a* and 2*b*, polypropylene foam sheets 0.3 mm thick each with a relative permittivity of 1.1; as the film substrate 4, a film substrate in the form of a polyimide film 25 μm thick with a glued copper foil 18 μm thick; and as the ground conductor 5, an aluminum plate 2.0 mm thick Further, as the metallic spacers 7*a* and 7*b*, aluminum plates 0.3 mm thick each were used.

The ground conductor 1 was formed, as illustrated in FIG. 3(*a*), with a through hole punched by the same dimensions as a cavity of the waveguide, such that a=1.27 mm, and b=2.54 mm. The metallic spacers 7*a* and 7*b* were punched to form with dimensions shown in FIG. 3(*b*), such that E1=2.3 mm, E2=2.3 mm, c=1.0 mm, and d=0.85 mm. The film substrate 4 was processed by an etching to form, as illustrated in FIG. 3(*c*), a combination of a strip line conductor 3 as a straight transmission line with a line width of 0.3 mm, and a quadrate resonant patch pattern 8 at a distal end thereof whereto the waveguide was to be positioned. This pattern had a dimension L1 in a direction of line connection as a free space wavelength $\lambda_0$ of desirable frequency times approximately 0.32, i.e., L1=1.25 mm, and a dimension L2 in a direction perpendicular to the direction of line connection as the free space wavelength $\lambda_0$ of desirable frequency times approximately 0.38, i.e., L2=1.5 mm.

Component parts of a configuration in part of FIG. 2 were arranged for lamination by use of guide pins and the like inserted therethrough from upside of the upper ground conductor 5, to screw as necessary for fixation to the ground conductor 1, so that they were assembled with an established well-precise coincidence among a center position of the through hole of ground conductor 1, center positions of cavity walls of dimensions E1 by E2 of the metallic spacers 7*a* and 7*b*, and a center position of the quadrate resonant patch pattern 8.

Figure 5:
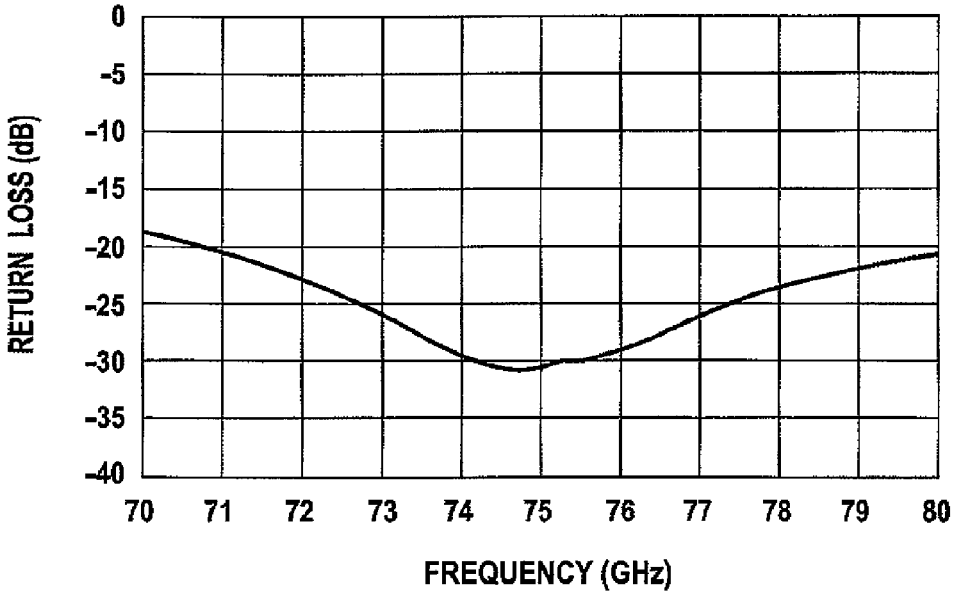
FIG. 5 is a graphic representation of a relationship between return loss and frequency according to an embodiment example of the present invention.

By the foregoing arrangement, the configuration in part of FIG. 2 was fabricated as a combination of input and output portions with a bilaterally symmetric appearance. Then, at one end of this, a waveguide was terminated on the output portion. The waveguide was connected to the input portion. Under this condition, reflection characteristics (i.e. Return Loss in dB vs. Frequency in GHz) were measured, with results illustrated by solid lines (i.e. Embodiment EX-1) in FIG. 5. There were characteristics of −20 dB or less observed as reflection losses about a desirable frequency of 76.5 GHz. In addition, there were characteristics of low reflection losses of −20 dB or less obtained in a lower range of frequencies than in the past.

INDUSTRIAL APPLICABILITY

According to the present invention, a triplate line-to-waveguide transducer is made up by component members such as a ground conductor 1, an upper ground conductor 5, and metallic spacers 7*a* and 7*b* that can be fabricated at a low cost by a punching, such as of a metallic plate with a desirable thickness, allowing for facile fabrication and high connection integrity, at a low cost, with a minimized lower limit of resonance frequency relative to a conventional configuration, without detriment to a low-loss characteristic over a wide bandwidth in the past.

The invention claimed is:

1. A triplate line-to-waveguide transducer including a transducer portion configured with and between a waveguide having a waveguide cavity and a triplate transmission line comprised of a film substrate formed with a strip line conductor and laminated over a surface of a lower ground conductor, with a first dielectric substrate in between; and an upper ground conductor laminated over a surface of the film substrate, with a second dielectric substrate in between, the triplate line-to-waveguide transducer comprising:

a through hole provided through an area on the lower ground conductor for connection with the waveguide, the through hole having dimensions substantially equal to cavity dimensions of the waveguide cavity;

a first metallic spacer provided as a holding element for the film substrate, with an even thickness to the first dielectric substrate and a first metallic spacer cavity defined by cavity dimensions larger than the cavity dimensions of the waveguide cavity, and cooperating with a second metallic spacer having a second metallic spacer cavity having cavity dimensions substantially equal to the cavity dimensions of the first metallic spacer cavity, to sandwich the film substrate in between;

the upper ground conductor being arranged on the other second metallic spacer;

a quadrate resonant patch pattern formed at an end of the strip line conductor formed to the film substrate, on an area corresponding to a transducer end of the waveguide; and a combination of the quadrate resonant patch pattern and the waveguide arranged for the quadrate resonant patch pattern to have a center position thereof coincident with a center position of the cavity dimensions of the waveguide cavity.

2. The triplate line-to-waveguide transducer according to claim 1, wherein the quadrate resonant patch pattern has a dimension thereof in a direction of line connection set as a free space wavelength $\lambda_0$ of desirable frequency times 0.30 to 0.34, and a dimension thereof in a direction perpendicular to the direction of line connection set as the free space wavelength $\lambda_0$ of desirable frequency times 0.32 to 0.4.

3. The triplate line-to-waveguide transducer according to claim 2, wherein the cavity dimensions of the first metallic spacer cavity and the cavity dimensions of the second metallic spacer cavity are set as a free space wavelength $\lambda_0$ of desirable frequency times 0.56 to 0.62.

4. The triplate line-to-waveguide transducer according to claim 1, wherein the cavity dimensions of the first metallic spacer cavity and the cavity dimensions of the second metallic spacer cavity are set as a free space wavelength $\lambda_0$ of desirable frequency times 0.56 to 0.62.

5. The triplate line-to-waveguide transducer according to claim 1, wherein an area dimension of the first metallic spacer cavity and an area dimension of the second metallic spacer cavity are both greater than an area dimension of the through hole provided through the lower ground conductor and an area dimension of the waveguide cavity.

* * * * *